US005597134A

United States Patent [19]

Marin

[11] Patent Number: 5,597,134

[45] Date of Patent: Jan. 28, 1997

[54] PERFECTED EXPANDING SHAFT

[75] Inventor: Giancarlo Marin, Montecchio Maggiore, Italy

[73] Assignee: Svecom PE Srl, Montecchio Maggiore, Italy

[21] Appl. No.: 496,291

[22] Filed: Jun. 29, 1995

[30] Foreign Application Priority Data

Mar. 3, 1995 [IT] Italy ..... VI95A0034

[51] Int. Cl.[6] ..... B65H 75/24

[52] U.S. Cl. ..... 242/571.2

[58] Field of Search ..... 242/530, 530.1, 242/530.3, 530.4, 571.2, 577, 577.1, 577.2, 577.3, 577.4, 578, 578.2, 597.1, 597.3, 599.2; 279/2.05, 2.06, 2.08

[56] References Cited

U.S. PATENT DOCUMENTS 4,026,491 5/1977 Bostroem ..... 242/530.3

*Primary Examiner*—John P. Darling

*Attorney, Agent, or Firm*— Watson Cole Stevens Davis, P.L.L.C.

[57] ABSTRACT

A cylindrical shaft has radial slots each for receiving one or more tubular supports. A plurality of mobile sectors located in the slots and expand radially by means of air tubes. At least one of said mobile sectors has two or more sliding bucking elements, for locking the tubular supports axially.

5 Claims, 2 Drawing Sheets

PERFECTED EXPANDING SHAFT

BACKGROUND OF THE INVENTION

1. Field of the Invention

The present invention concerns a perfected expanding shaft, consisting of an shaft provided with radially mobile elements and with axially mobile elements for the locking of tubular supports coupled with the shaft itself.

2. General State of the Art

It is well known that shafts with expanding elements are very often used to sustain tubular supports on which plastic, aluminium or paper films are wound up or, vice versa, to support the reels when they have to be unwound.

Said expanding shafts, according to a known application, are provided with a plurality of radially mobile sectors, inserted inside slots carried out along the generating lines of the shafts themselves, which buck against the inner surface of the tubular support on/from which the reel is wound/unwound.

The radial exit of the mobile sectors from the relevant slots is generally obtained by means of the thrust due to the inflation of air tubes positioned at the bottom of the slots which house said mobile sectors.

Said expanding shafts are also used to wind up plastic or paper films starting from a single reel which is unwound while supported by another expanding shaft. In this case, as the film is unwound from the reel, it passes through a cutting unit which divides it in strips of the desired length. Each one of said strips is wound on a tubular support coaxially lined with a plurality of further tubular supports, all of which are externally coupled with the same winding expanding shaft.

The skilled persons know that the transversal section of the film which is unwound from the reel doesn't have constant thickness; consequently, not all the supports arranged on the winding expanding shaft, on which the strips obtained from the cutting of the film are wound, have the same diameter at any moment.

Since the winding expanding shaft revolves at constant rpm, the rim speeds of the forming film reels positioned side by side are different; consequently, each film is wound with more or less tension according to said difference in diameter.

In order to eliminate said drawback, upon the increasing of the winding tension each reel should be capable of sliding on the expanding shaft on which it is positioned for the time required to allow the other reels, positioned beside it, to reach the same diameter, so that the tension in each of them is exactly the same.

The expanding shafts of the known type described above offer a solution of the problem which isn't completely satisfying, as the mobile sectors consist of rectilinear metal blocks which are not perfectly suitable for ensuring the friction of the tubular supports on which the film strips are wound.

A further drawback is represented by the fact that during the winding the tubular supports, due to their limited width and also to the winding tension, do not remain rigorously orthogonal to the rotation axis of the expanding shaft, but tend to take an inclined position which compromises both the geometry of the forming rolls and the correct winding tension.

SUMMARY OF THE INVENTION

In order to eliminate the drawbacks described above, the applicant for the registration of the present invention carried out an invention which is the object of the Italian patent application VI93A000011, wherein an expanding shaft is disclosed comprising a cylindrical shaft provided with a plurality of radial slots carried out along its generating lines, where each one of said slots houses one or more mobile sectors, each sector being composed of a plurality of blades coupled in packs and facing one another. When radially expanded with thrusting means, said blades create a radial contact through friction in correspondence with the inner surface of each one of said tubular supports.

The invention described in the patent registered as indicated above offers an optimal solution for the problem of the friction of the tubular supports against the expanding shaft, but doesn't solve the problem regarding their axial locking satisfactorily. In fact, the axial locking of the tubular supports depends on the bucking of the mobile sector blades, which protrude from the tubular support, against the edges of the tubular supports themselves. Sometimes said bucking isn't sufficient to ensure a good axial locking.

The present invention intends to overcome said limit and aims at the implementation of an expanding shaft capable of ensuring both the radial locking with friction and the axial locking of the tubular supports coupled with said shaft at the same time.

A further aim is to reach the shaft so that the axial locking on the tubular supports is sufficient to prevent these from taking, during the winding, an inclined position with respect to the shaft rotation axis, thus compromising the cylindricality of the winding.

The goals described above have been achieved through the implementation of a perfected expanding shaft, which, according to the main claim, comprises:

- a cylindrical shaft provided with a plurality of radial slots carried out along its generating lines and suitable for sustaining one or more tubular supports coaxially coupled outside it;
- a plurality of mobile sectors, each one introduced in one of said slots and expanding radially through thrusting means positioned inside each one of said slots and co-operating with each one of said mobile sectors;

and wherein at least one of said mobile sectors is provided with a seat developed longitudinally, in which one or more bucking elements are slidingly inserted, said bucking elements being suitable for axially locking said tubular supports when they are locked in said seat, through locking means, facing the side edges of said tubular supports.

As far as said mobile sectors are concerned, according to a favourite application they consist of strips made of plastic material or alike, introduced in the slits made on the shaft. At least one of said mobile sectors is provided with a longitudinal seat inside which there are bucking elements consisting of blocks which can be manually moved along said longitudinal seat and which are locked facing the tubular supports through fastening means.

According to another application, the mobile sectors which are not provided with a longitudinal slot can consist of a plurality of thin blades coupled in packs and facing one another, as provided by the already mentioned Italian patent application VI93A000011.

BRIEF DESCRIPTION OF THE DRAWINGS

The above goals will be better highlighted in the description of a practical application among many of the invention in question, illustrated in the attached drawings wherein.

DESCRIPTION OF THE PREFERRED EMBODIMENT

Figure 1:
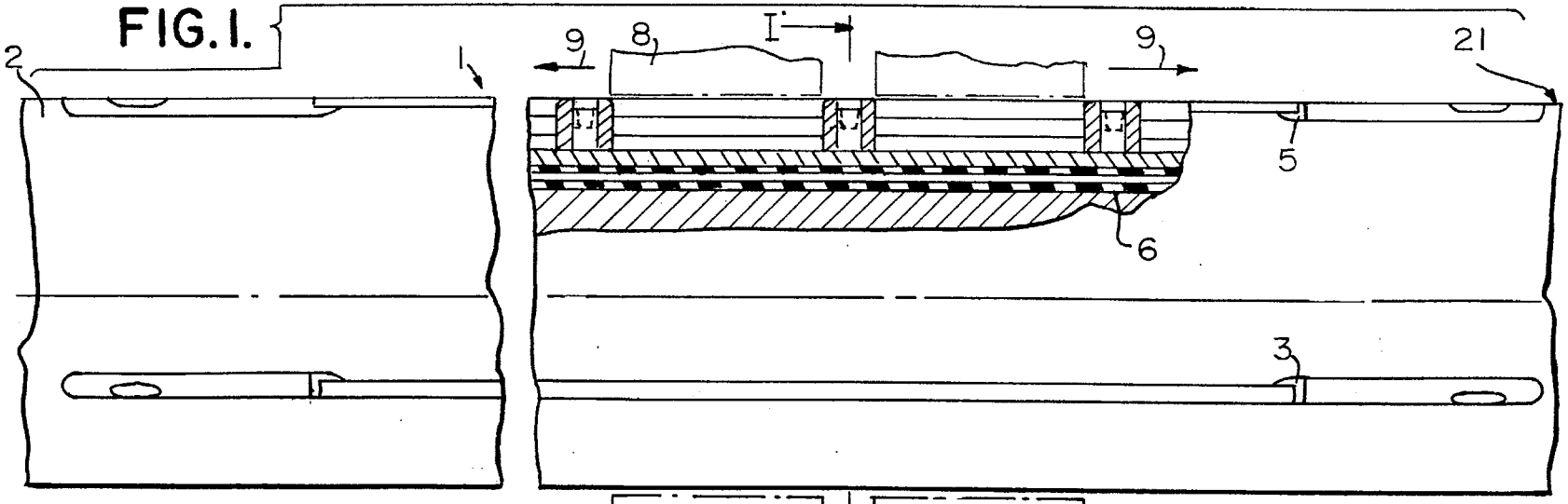
FIG. 1 shows the expanding shaft object of the present invention supporting some tubular supports coupled with it and arranged in resting position.
Figure 3:
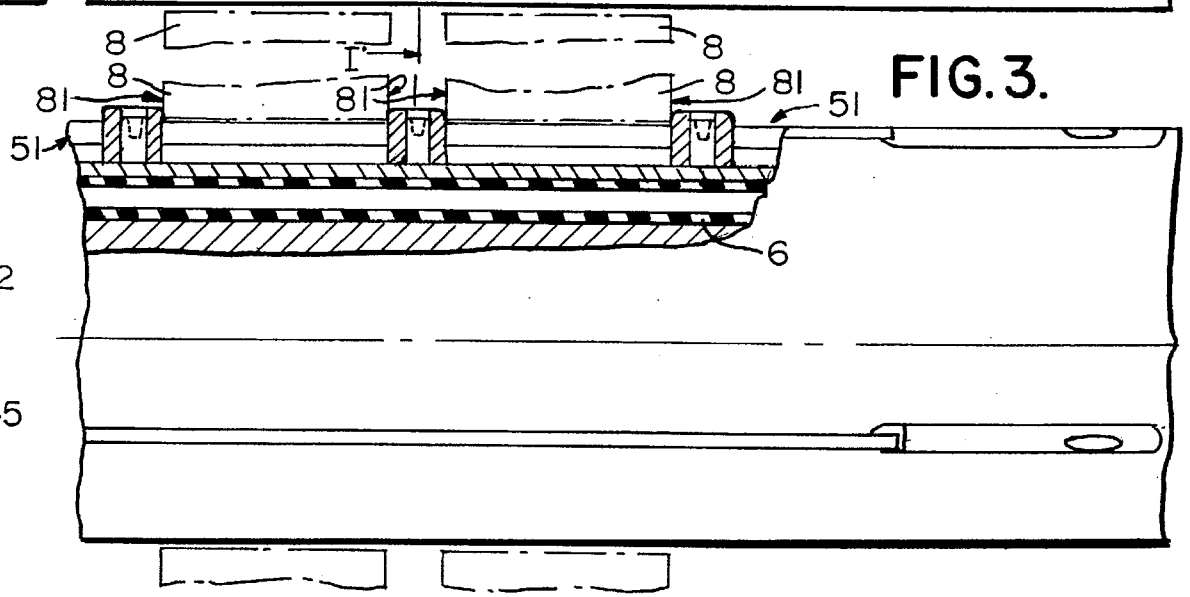
FIG. 3 shows the transversal section of the expanding shaft of FIG. 1 carried out according to the plane I—I.
Figure 2:
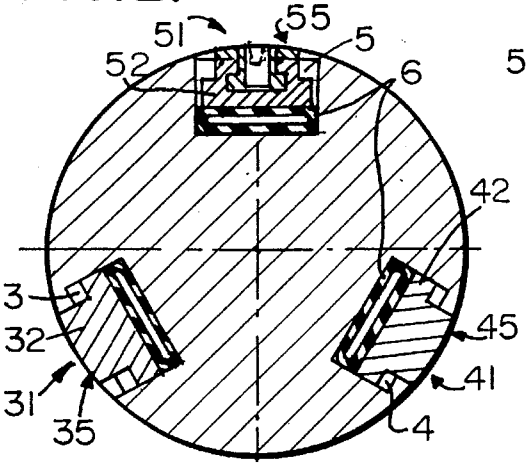
FIG. 2 shows the expanding shaft of FIG. 1 with the tubular supports locked in the winding position.
Figure 5:
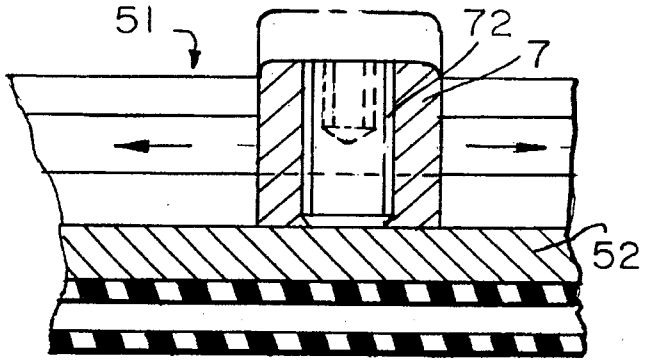
FIG. 5 shows the side view of the mobile sector represented in FIG. 4.

As shown in FIGS. 1, 2 and 3, the expanding shaft object of the present invention, indicated as a whole by 1, comprises a cylindrical shaft 2 provided with a plurality of radial slots 3, 4 and 5, in each one of which a mobile sector, 31, 41 and 51 respectively, is inserted. Said mobile sectors are radially expanded through thrusting means consisting of air tubes 6, each one of which is positioned at the bottom of a slot and under the relevant mobile sector. Air under pressure is blown into said air tubes 6 and is conveyed by means of ducts carried out in the shaft 2 and not represented in the figure.

It is shown in the same figures, and in detail in the figures from 4 to 7, that each one of said mobile sectors consists of a strip, mainly longitudinal, the transversal section of which, 32, 42 and 52 respectively, is T-shaped. This makes it possible to introduce the mobile sectors in the relative slots 3, 4 and 5, the profile of which is substantially T-shaped, too.

Figure 7:
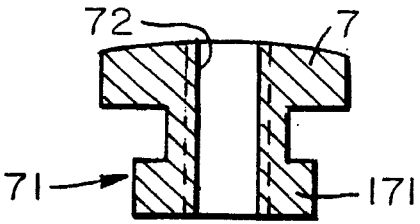
FIGS. 6 and 7 show the constitutive elements of said mobile sector represented in FIGS. 4 and 5.
Figure 4:
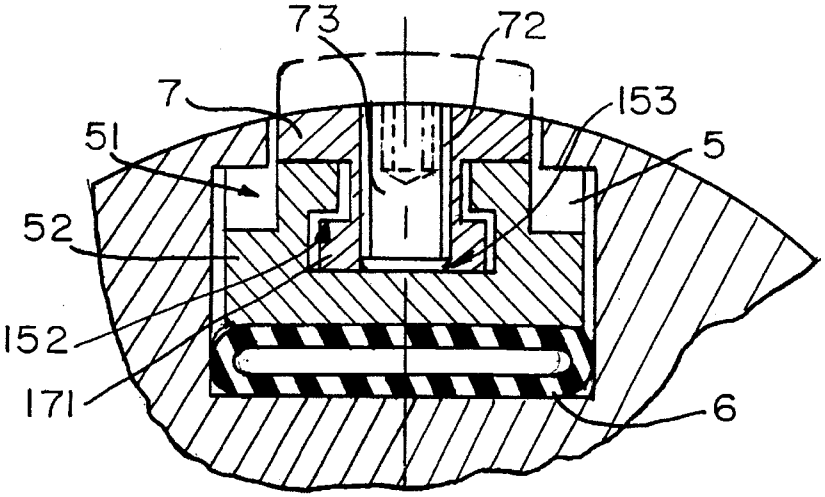
FIG. 4 shows the mobile sector represented in FIG. 3, provided with blocks for the axial locking of the tubular supports, in detail.
Figure 6:
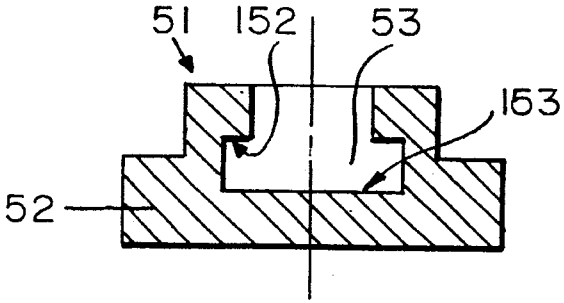

It can be observed also that the mobile sector 51, differently from the other mobile sectors 31 and 41 adjacent to it, is provided with a seat 53, which also has a substantially T-shaped transversal profile and machined in the whole longitudinal length of the mobile sector itself. Inside said seat 53 there is a bucking element which, as shown in detail in FIG. 7, consists of a block 7 having the body 71 shaped according to a T-shaped male profile suitable for being introduced in the corresponding seat 53 made in the mobile sector 51. Further, said block 7 is also provided with a threaded through hole 72 in which it is possible to screw a screw 73 allowing the locking of the block in the relevant seat 53.

All the mobile sectors 31, 41 and 51 have a curved external profile, 35, 45 and 55 respectively, the radius of curvature of which is equal to the radius of the transversal section of the shaft 2. In this way, when the air tubes 6 are not inflated, they take the positions shown in FIG. 2, with the external surfaces not protruding from the perimeter 21 of the external surface of the shaft 2 itself, thus making it possible to insert the tubular supports 8 in the shaft 2. The tubular supports 8 are arranged as shown in FIG. 1 and also in FIG. 3, each included between a couple of blocks 7, which are positioned by making them slide along the seat 53 of the relevant mobile sector 51, moving them axially according to any of the senses of the arrows 9, until they face the side edges 81 of each tubular support 8. The locking of each block 7 in the reached position is obtained by screwing the screw 73, which pushes against the bottom 153 of the seat 53 and forces the T-shaped profile 171 of the body 71 of said block against the undercuts 152 of the mobile sector 51.

Once this arrangement has been reached, air is blown into the air tubes 6, which causes the expansion of the mobile sectors with which they cooperate. This way, the external surfaces 35 and 45 of the mobile sectors 31 and 41 adhere to the internal surface of each tubular support 8, allowing its friction during the winding. On the other hand, each couple of blocks 7, by bucking laterally against a tubular support 8 included between the two blocks, keeps the tubular support itself axially steady, thus avoiding any movement during the winding.

Further, said axial locking also avoids the misalignment of the tubular support 8 with respect to the axis of the shaft 2, thus preventing the film from being wound on the tubular support 8 with a configuration other than cylindrical.

The above description shows that the present invention achieves the fixed goals.

According to the invention, in fact, it is possible to implement an expanding shaft which ensures, during the winding, both the friction of the tubular supports positioned on it and the axial locking of the tubular support at the same time.

A further aim is achieved, that is, the implementation of an expanding shaft so that during the winding each tubular support not only doesn't move axially along the shaft on which it is placed, but remains perfectly coaxial to it, thus preventing any misalignment which can cause an irregular winding of the film.

Obviously, the expanding shaft can be carried out with any number of mobile elements, where one or more of said mobile elements can be provided with said sliding blocks for the axial locking of the tubular element being wound.

Further, said blocks and the seats in which said blocks slide inside the relevant mobile sector, can have different dimensions, shape and also different kind of locking.

All the mentioned variants and any other change which may be necessary upon implementation are to be regarded as completely protected by the present invention.

I claim:

1. An expanding shaft, comprising:

a cylindrical shaft formed with a plurality of elongated axially aligned radial slots for receiving one or more coaxially coupled external tubular supports having side edges;

a plurality of mobile sectors, each one located in one of said slots;

thrusting means positioned inside each of said slots located in the slot between the shaft and the inwardly mobile sector and cooperating with each one of said mobile sectors to urge the mobile sector outwardly, wherein at least one of said mobile sectors is formed with a longitudinal seat;

two or more bucking elements slidingly inserted in the seat for engaging the side edges of and axially locking said tubular supports in said seat; and locking means in the bucking element for locking the tubular supports.

2. The expanding shaft according to claim 1 wherein each one of said mobile sectors comprises a generally longitudinal strip, having a transversal section in the form of a T-shaped profile and each of said slots has a corresponding mating profile for receiving the mobile sector therein.

3. The expanding shaft according to claim 2 wherein the seat of the at least one of said mobile sectors covers at least a part of its length for housing two or more of the bucking elements, each bucking element comprising a block having the body locatable in in said seat of said mobile sector, each of said blocks having a transversal section substantially matching the T-shaped profiles.

4. The expanding shaft according to claim 3 wherein said bucking element has a through hole and the locking means comprises a screw located in the through hole for pushing against the bottom of said mobile sector, to reciprocally lock said bucking element in said mobile sector though the reciprocal interference of said substantially T-shaped matching profiles.

5. The expanding shaft according to claim 1 wherein said thrusting means comprises air tubes, one each located at the bottom of each of said slots and supporting the mobile sector inserted in said slot.

* * * * *